US007182634B2

(12) United States Patent
Tran

(10) Patent No.: US 7,182,634 B2
(45) Date of Patent: Feb. 27, 2007

(54) CONNECTOR CELL HAVING A SUPPORTED CONDUCTIVE EXTENSION

(75) Inventor: Donald T. Tran, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/881,779

(22) Filed: Jun. 29, 2004

(65) Prior Publication Data

US 2005/0287867 A1 Dec. 29, 2005

(51) Int. Cl.
*H01R 13/60* (2006.01)

(52) U.S. Cl. ..... 439/539

(58) Field of Classification Search ..... 439/539, 439/66, 71, 81, 72, 83
See application file for complete search history.

(56) References Cited

U.S. PATENT DOCUMENTS 3,281,753 A * 10/1966 Fink ..... 439/291
4,068,915 A * 1/1978 Evans ..... 439/637
4,684,184 A * 8/1987 Grabbe et al. ..... 439/64
4,701,002 A * 10/1987 Mouissie ..... 439/426
4,959,029 A * 9/1990 Grabbe ..... 439/862
5,139,427 A * 8/1992 Boyd et al. ..... 439/66
6,042,387 A * 3/2000 Jonaidi ..... 439/66
6,157,538 A * 12/2000 Ali et al. ..... 361/704
6,347,394 B1 * 2/2002 Ochoa et al. ..... 716/6
6,493,241 B1 * 12/2002 Horng ..... 361/818
6,671,785 B2 * 3/2003 Guerin et al. ..... 29/884
6,645,012 B2 * 11/2003 Ito et al. ..... 439/637
6,669,499 B2 * 12/2003 Whyne et al. ..... 439/342
6,794,561 B2 * 9/2004 Allen ..... 800/295

* cited by examiner

*Primary Examiner*—Tulsidas C. Patel
*Assistant Examiner*—Phuongchi Nguyen
(74) *Attorney, Agent, or Firm*—Schwabe, Williamson & Wyatt, P.C.

(57) ABSTRACT

An apparatus, method, and system for a connector cell having an electrically and/or mechanically supported conductive extension are disclosed herein.

20 Claims, 4 Drawing Sheets

CONNECTOR CELL HAVING A SUPPORTED CONDUCTIVE EXTENSION

FIELD

Disclosed embodiments of the present invention relate to the field of integrated circuits, and more particularly to connectors used to interconnect integrated circuits with other components.

BACKGROUND

Integrated circuits (ICs) are typically formed in a semiconductor package that may be connected to a board, such as a printed circuit board (PCB), through a connector. The connector may enable the IC, such as a processor, to communicate with other components coupled to the board, such as the main system memory or a chipset. Advancements in IC technology have led to ICs dealing with increased current levels. As current flow to and from the IC increases, contact resistance in connector cells of the connector may generate significant amounts of heat, which could present inefficiencies related to signal throughput and electrical losses.

Prior art attempts to reduce the heat generated by this contact resistance are to either add more connector cells, and therefore decrease the amount of current flow through each connector cell, or to create bigger contact beams in each cell. However, both attempts translate to an increase in the semiconductor package footprint, which could raise costs and reduce yield.

BRIEF DESCRIPTION OF THE DRAWINGS

Embodiments of the invention are illustrated by way of example and not by way of limitation in the figures of the accompanying drawings, in which the like references indicate similar elements and in which.

DETAILED DESCRIPTION

A method, apparatus, and system for a connector cell having a conductive extension with an augmented current capacity are disclosed herein. In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the embodiments of the present invention. It should also be noted that references such as top and bottom and directions such as up and down may be used in the discussion of the drawings. These are used to facilitate the discussion of the drawings and are not intended to restrict the application of the embodiments of this invention. Therefore, the following detailed description is not to be taken in a limiting sense and the scope of the embodiments of the present invention are defined by the appended claims and their equivalents.

Figure 1:
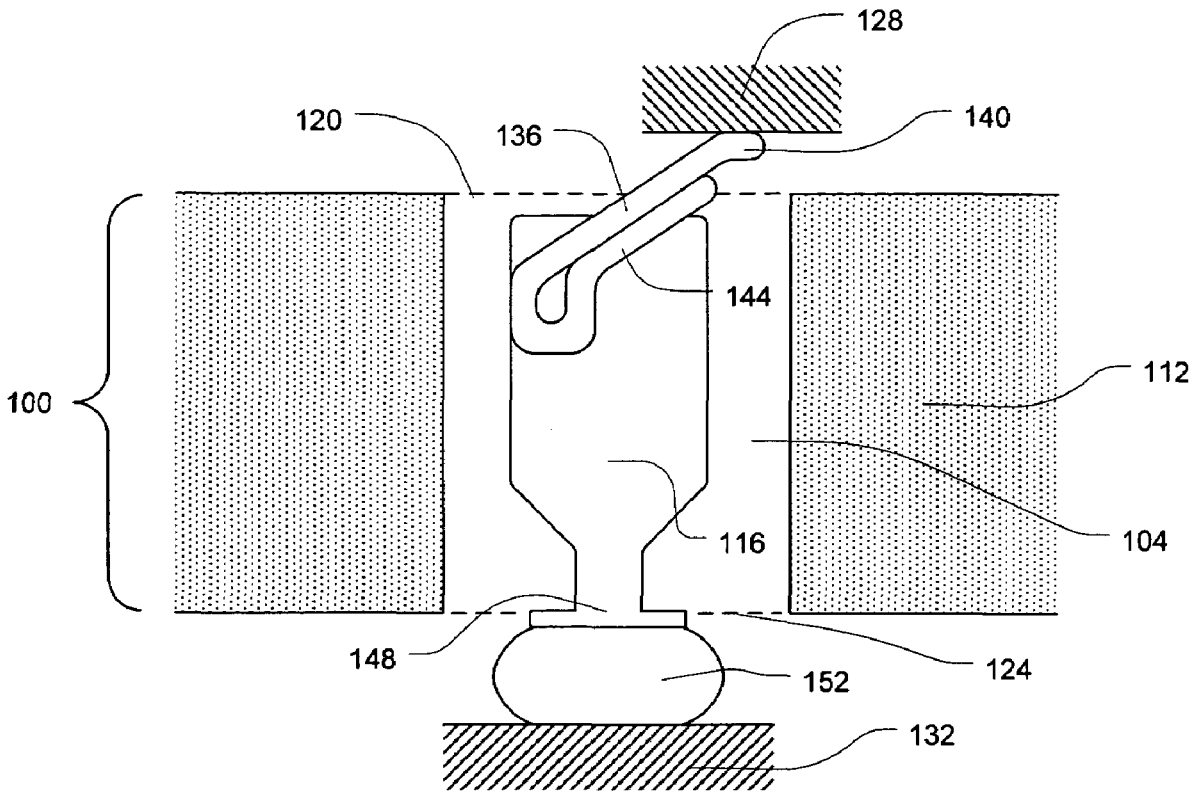
FIG. 1 illustrates a connector cell with a supported conductive extension, in accordance with an embodiment of the present invention.

FIG. 1 illustrates a connector 100 having a connector cell 104 with a supported conductive extension in accordance with an embodiment of the present invention. The connector 100 may include a base 112, which may be made of a resilient, nonconductive material (e.g., ceramic, plastic, glass, etc.), to house the connector cell 104. The connector cell 104 may include a conductive body 116 coupled to an inner surface of the base 112. In one embodiment the conductive body 116 may include a copper alloy that is plated with nickel; however, various embodiments could use a wide variety of conductive materials and coatings. In another embodiment, the conductive body 116 may include a nonconductive core, overlaid with a conductive coating. In one embodiment, the connector cell 104 may include two openings 120 and 124 to provide electrical interfaces to the body 116. The two openings 120 and 124 may be distally located relative to one another, and may correspond with a semiconductor contact 128 and a board contact 132, respectively.

In one embodiment, the conductive body 116 may be electrically coupled to the semiconductor contact 128 through a supported conductive extension. In various embodiments, the conductive extension may be electrically and/or mechanically supported. In this embodiment, the supported conductive extension may be a first finger 136, which may include a contact tip 140 that physically couples to the semiconductor contact 128. The first finger 136 may be made of materials similar to the body 116. The first finger 136 may be coupled to the body 116 and may be adapted to provide the connector cell 104 with a current capacity. In one embodiment, a second finger 144, coupled to the body 116, may be complementarily adapted to augment the current capacity of the connector cell 104 provided by the first finger 136. In one embodiment, the second finger 144 may augment the current capacity by providing mechanical support to the first finger 136. As a compressive force presses the connector 100 together with the semiconductor contact 128, this mechanical support may at least facilitate an increase in the amount of reactive upward contact force the contact tip 140 exerts on the semiconductor contact 128. This increased contact force may facilitate a secure and robust connection between the semiconductor contact 128 and the conductive body 116. This secure connection may potentially reduce the contact resistance in the signal path between the two components, which may decrease the amount of the resistive heat generated that would otherwise serve as a limitation to current capacity.

The mechanical support provided by the second finger 144 may also augment the current capacity of the cell 104 by allowing the first finger 136 to have a large contact tip 140. In order to support a large contact tip, a prior art design would have to reinforce the unsupported conductive extension, which would sacrifice at least some of the desirable deflection properties and resilient contact force of the present embodiment. Having a plurality of stacked fingers as shown in this embodiment may allow increased density in the connector cell pitch due to sufficient contact force being acquired without the large cell dimensions necessary to accommodate one large, rigid finger of prior art designs.

In one embodiment the second finger 144 may include a conductive material similar to the body 116. This may augment the current capacity of the cell 104 by providing a larger conductive conduit for electron flow from the contact tip 140 to the body 116.

In one embodiment, the first and second fingers 136 and 144 may be formed from a single piece of material. For example, in one embodiment a piece of metal stock may be bent over on itself, with the two ends of the piece of metal corresponding to the first and second fingers 136 and 144. In this embodiment, the bent area may be attached to the conductive body 116. In other embodiments the first and second fingers 136 and 144 may be formed from separate pieces of material.

Figure 2:
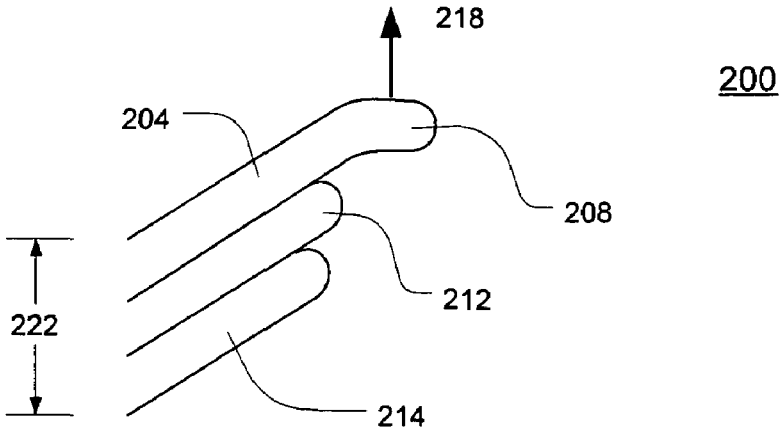
FIG. 2 illustrates a plurality of stacked fingers used to augment the current capacity of the cell provided by the first finger, in accordance with an embodiment of the present invention.

FIG. 2 illustrates a conductive extension 200 including a plurality of stacked fingers, in accordance with an embodiment of the present invention. In particular, this embodiment may include a first finger 204 with a fist contact tip 208 to provide a current capacity to a connector cell (not shown). Furthermore, this embodiment may include a second and third finger 212 and 214 to augment the current capacity provided to the connector cell by the first finger 204 alone. In one embodiment, the second and third fingers 212 and 214 may provide mechanical support in order to increase the contact force 218 and/or to support a larger contact tip 208. In one embodiment, the second and third fingers 212 and 214 may augment the current capacity of the cell by additionally/alternatively increasing the thickness 222 of the conductive conduit to the body. The number, dimensions, and types of support fingers may be adjusted to accommodate for the design objectives and constraints of a particular embodiment.

Referring again to the embodiment depicted in FIG. 1, the conductive body 116 may be electrically coupled to the board contact 132 through another conductive extension. In one embodiment, this conductive extension may be in the form of a solder ball pedal 148 that may be coupled to a solder ball 152. Various embodiments may employ different styles of connections between the board contact 132 and the conductive body 116 without departing from the scope of this invention.

Figure 3:
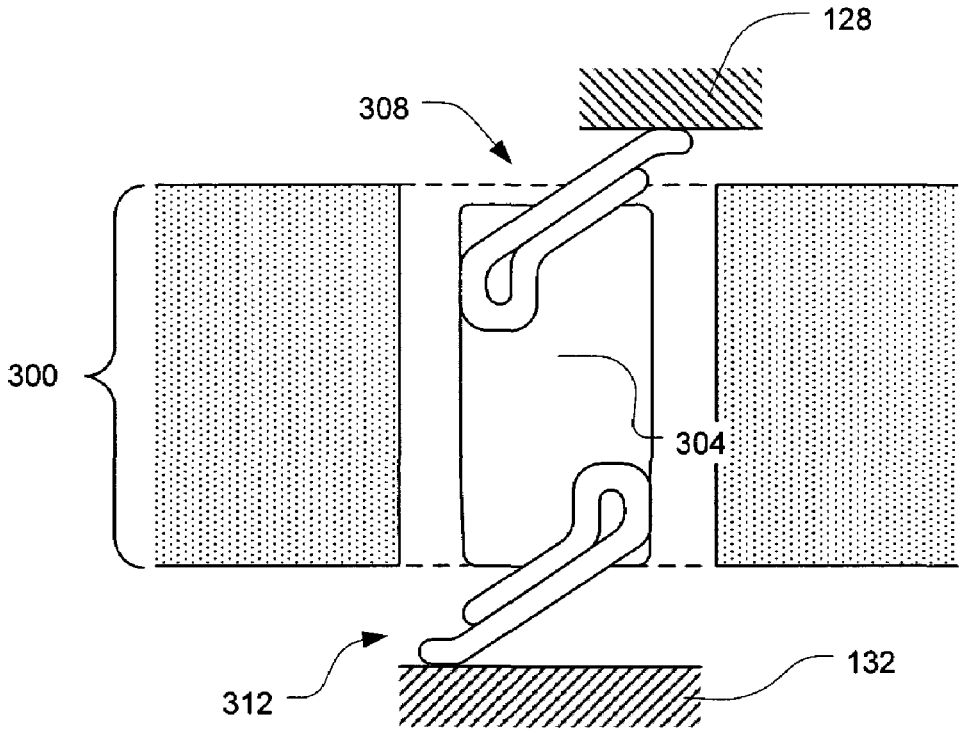
FIG. 3 illustrates a conductive body being electrically coupled to the board contact through a supported conductive extension, in accordance with an embodiment of the present invention.

FIG. 3 illustrates an embodiment of a connector 300 having a conductive body 304 electrically coupled to the semiconductor contact 128 and the board contact 132 through supported conductive extensions 308 and 312, respectively. The use of conductive extensions to couple the body 304 to both the semiconductor contact 128 and the board contact 132 may sometimes be referred to as a double compression connector cell. In various embodiments, one of the conductive extensions 308 and 312 may also be unsupported.

Figure 4:
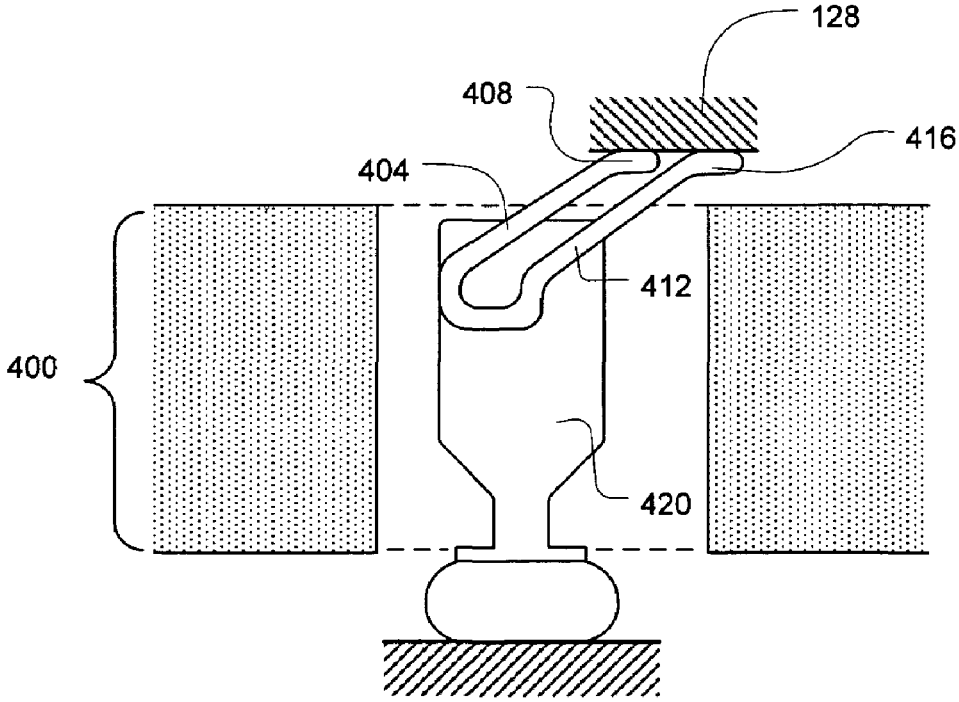
FIG. 4 illustrates a connector having an electrically supported conductive extension, in accordance with an embodiment of the present invention.

FIG. 4 illustrates an embodiment of a connector 400 having a first conductive extension electrically supported by a second conductive extension, in accordance with an embodiment of the present invention. In particular the first conductive extension may include a first finger 404 with a contact tip 408 to provide a connector cell 410 with a current capacity. The second conductive extension, which may include a second finger 412 and a contact tip 416, may augment the current capacity provided by the first finger 404 by providing another electrically conductive path to a conductive body 420. The two contact tips 408 and 416 of this embodiment may increase the contact area of the electrical interface, while maintaining desired deflection properties and resilient contact forces. Increasing the number of contact points between the semiconductor contact 128 and the conductive body 420 may decrease the effective contact resistance and increase the current capacity in the signal path between the two components.

Figure 5:
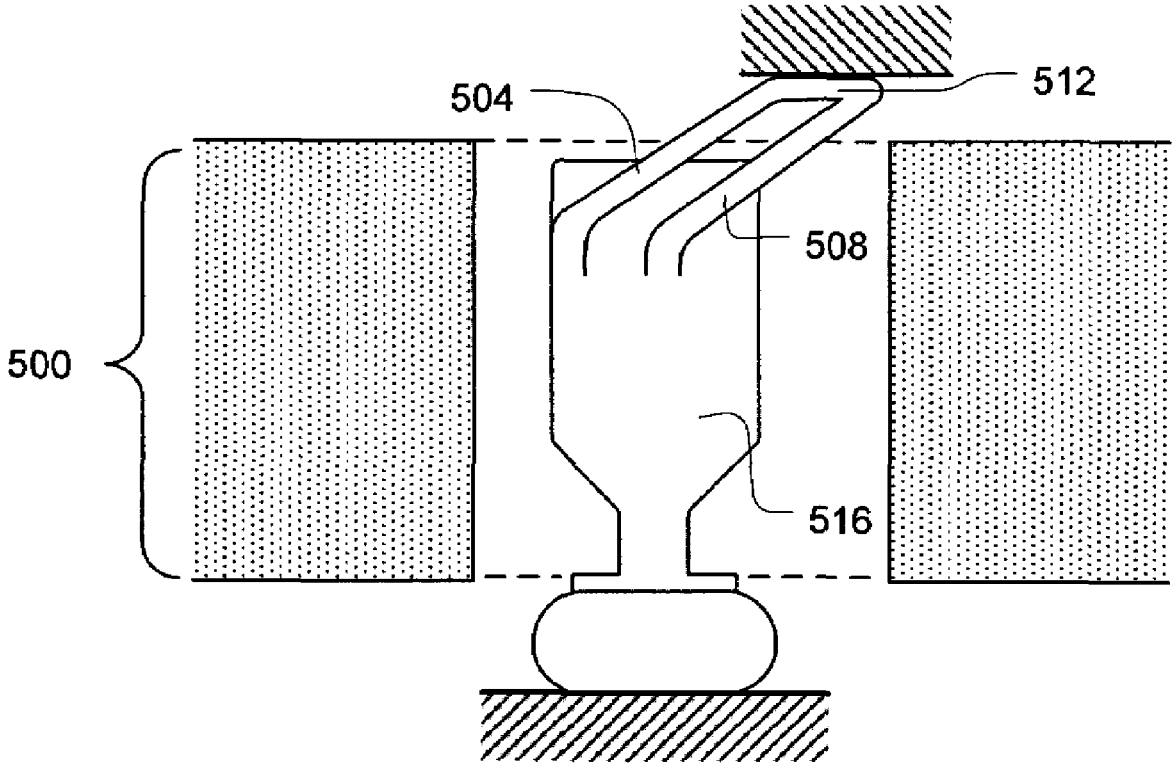
FIG. 5 illustrates a connector cell including a dual conductive extension sharing the same contact tip, in accordance with an embodiment of the present invention.

FIG. 5 illustrates a connector 500 of another embodiment of the present invention. The connector 500 is similar to the connector 400 of the embodiment depicted in FIG. 4; however, in this embodiment a first finger 504 and a second finger 508 share the same contact tip 512. In this embodiment, the second finger 508 may augment the current capacity of the first finger 504 by increasing the contact area and/or by providing mechanical support to the first finger 504. Additionally, in this embodiment the first finger 504 and the second finger 508 may be coupled to a conductive body 516 at two different points, as shown. Earlier embodiments, including the conductive extensions depicted in FIGS. 1, 2, 3, and 4, may have the fingers coupled to the body in similar manners.

Similar to discussion regarding FIG. 1 embodiment, the first and second fingers 504 and 508 may be formed from the same piece of material. However, in this embodiment, the bent area may correspond to the contact tip 512 while the ends may be coupled to the conductive body 516.

Figure 6:
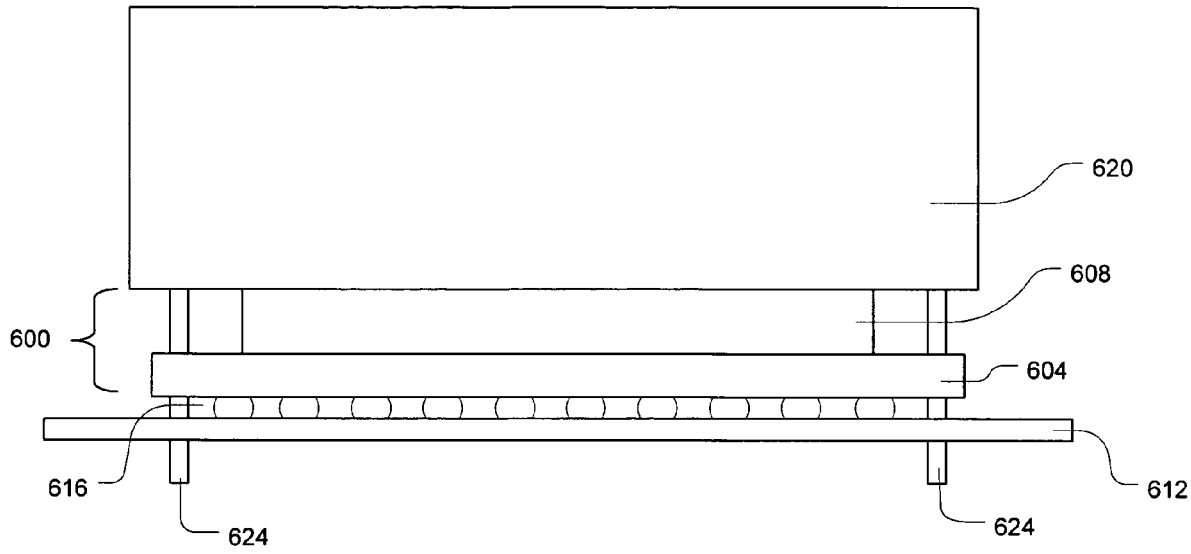
FIG. 6 illustrates an electronic assembly that includes a connector and a semiconductor package, in accordance with an embodiment of the present invention.

FIG. 6 illustrates an electronic assembly 600 that includes a connector 604 and a semiconductor package 608, in accordance with an embodiment of the present invention. The connector 604 may be similar to connectors 100, 300, 400, or 500 depicted in the above embodiments. The semiconductor package 608 may include an integrated circuit (IC). High-speed input/output (I/O) signals, ground, and power may be routed to and from the IC through electrically conductive paths, called traces, in the semiconductor package 608. These traces may be formed by constructing the semiconductor package with alternating layers of conducting and dielectric materials. These traces may correspond to semiconductor contacts on the bottom side of the semiconductor package 608.

In one embodiment the semiconductor package 608 may be connected to a board 612 through the connector 604 in order to interconnect multiple components such as other semiconductor packages, high-power resistors, mechanical switches, capacitors, etc. The connector 604 may have a number of connector cells that are aligned with the respective contacts of the semiconductor package 608 and the board 612. In one embodiment, at least one of the connector cells may include a plurality of fingers that cooperate to electrically couple the respective semiconductor contact to the connector cell. In one embodiment the connector 604 may be a land grid array connector, and the substrate package 608 may be a land grid array module.

In one embodiment, the board contacts may be aligned with an array of solder balls 616, which in turn may be aligned with the respective connector cells. In other embodiments, the board 612 may be coupled to the connector 604 by other connector cell actuation designs including, for example, a variety of surface mount technologies. Examples of the board 612 could include, but are not limited to a carrier, a printed circuit board (PCB), a printed circuit card (PCC), and a motherboard. Board materials could include, but are not limited to ceramic (thick-filmed, cofired, or thin-filmed), plastic, and glass.

In one embodiment, the semiconductor package 608 may be thermally coupled to a thermal management device 620, as shown. The thermal management device 620 may at least facilitate the dispersion of excess heat generated by the semiconductor package 608. In various embodiments the thermal management device may include a passive device, e.g., a finned heatsink, or a forced convection device, e.g., a microchannel cold plate.

In one embodiment a compressive force may be exerted on the electronic assembly 600 by one or more load posts 624. The compressive force may compress the semiconductor package 608 to the connector 604 to ensure a secure connection between the connector cells and the semiconductor contacts. In various embodiments the load posts 624 may be used to additionally/alternatively compress any combination of the other components including, but not limited to the thermal management device and the semiconductor package; and the connector and the board 612.

Figure 7:
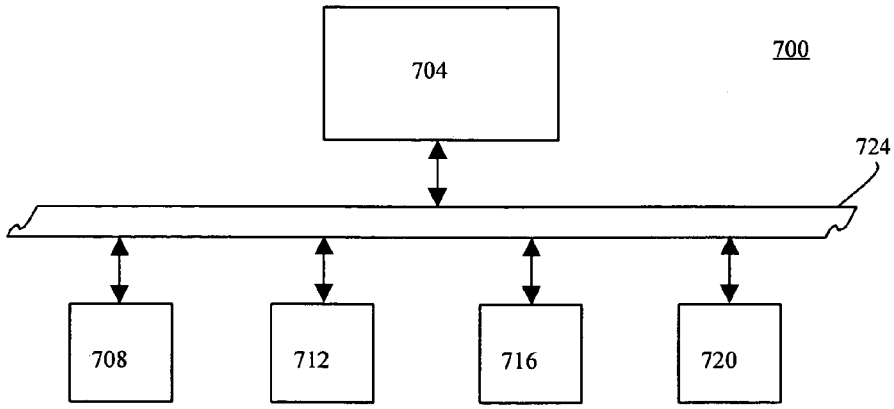
FIG. 7 illustrates a system incorporating an electronic assembly, in accordance with an embodiment of the present invention.

Referring to FIG. 7, there is illustrated one of many possible systems in which embodiments of the present invention may be used. In this embodiment, a system 700 may include an electronic assembly 704 that may be similar to the electronic assembly 600 of the embodiment depicted in FIG. 6. In one embodiment, the electronic assembly 704 may include a processor, such as, but not limited to, a microprocessor, a microcontroller, and a digital signal processor. In various embodiments, the electronic assembly 704 may include an application specific IC (ASIC). Integrated circuits found in chipsets (e.g., graphics, sound, and control chipsets) may also be connected in accordance with embodiments of this invention.

For the embodiment depicted by FIG. 7, the system 700 may also include a main memory 708, a graphics processor 712, a mass storage device 716, and an input/output module 720 coupled to each other by way of a bus 724, as shown. Examples of the memory 708 include, but are not limited to, static random access memory (SRAM) and dynamic random access memory (DRAM). Examples of the mass storage device 716 include, but are not limited to, a hard disk drive, a compact disk drive (CD), a digital versatile disk drive (DVD), and so forth. Examples of the input/output modules 720 include, but are not limited to, a keyboard, cursor control devices, a display, a network interface, and so forth. Examples of the bus 724 include, but are not limited to, a peripheral control interface (PCI) bus, an Industry Standard Architecture (ISA) bus, and so forth. In various embodiments, the system 700 may be a wireless mobile phone, a personal digital assistant, a pocket PC, a tablet PC, a notebook PC, a desktop computer, a set-top box, a media-center PC, a DVD player, and a server.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A connector comprising:

a first connector cell having a body; and a conductive extension having a plurality of stacked fingers including a first finger having an end coupled to the body, a first side having a contact surface, and a second side opposite the first side, the first finger adapted to provide the first connector cell with a first current capacity, and a second finger, having an end coupled to the body, the second finger bent in a manner to couple to the second side of the first finger while the first finger is in a non-deflected state to augment the first current capacity provided by the first finger to the first connector cell; and a second connector cell having a second current capacity.

2. The connector of claim 1, wherein the second finger is to augment the first current capacity by being adapted to provide mechanical support to the first finger.

3. The connector of claim 1, wherein the connector is a land grid array connector comprising said first and second connector cells.

4. The connector of claim 1, wherein the second connector cell includes a third and a fourth finger, where the third finger is adapted to at least contribute to providing the second connector cell with said second current capacity, and the fourth finger is complementarily adapted to augment the contribution to the second current capacity provided by the third finger to the second connector cell.

5. The connector of claim 4, wherein the connector is a land grid array connector comprising said first and second connector cells.

6. A system comprising:

an integrated circuit disposed within a semiconductor package;

a board coupled to the semiconductor package through a connector; and the connector having a connector cell including:

a body; and a conductive extension having a plurality of stacked fingers including a first finger, having an end coupled to the body, a first side having a contact surface, and a second side opposite the first side, the first finger adapted to electrically couple the semiconductor package to the body; and a second finger, having an end coupled to the body, the second finger bent in a manner to couple to the second side of the first finger to cooperate with the first finger to electrically couple the semiconductor package to the body; and a mass storage device coupled to the semiconductor package.

7. The system of claim 6, further comprising:

a plurality of load posts to provide a compressive force between the semiconductor package and the connector.

8. The system of claim 6, wherein the board comprises a motherboard.

9. The system of claim 6, wherein the semiconductor package comprises a land grid array module.

10. The system of claim 9, wherein the connector comprises a land grid array connector.

11. The system of claim 6, wherein the integrated circuit is a processor.

12. The system of claim 11, wherein the system is a selected one of a group consisting of a set-top box, a media-center personal computer, and a digital versatile disk player.

13. The system of claim 11, wherein the input/output interface comprises a networking interface.

14. A connector cell comprising:

a body; and a conductive extension having a plurality of stacked fingers including a first finger having an end coupled to the body, a first side having a contact surface, and a second side opposite the first side, the first finger adapted to provide the connector cell with a first current capacity, and a second finger having an end coupled to the body, the second finger bent in a manner to couple to the second side of the first finger while the first finger is in a non-deflected state to augment the first current capacity provided by the first finger to the connector cell.

15. The connector cell of claim 14, wherein the second finger is to augment the first current capacity by being adapted to provide mechanical support to the first finger.

16. The connector cell of claim 14, wherein the second finger includes a contact surface, and the contact surfaces of the first and second fingers are adapted to provide a first electrical interface for the connector cell.

17. The connector cell of claim 14, wherein the first and second fingers are formed from a single piece of material.

18. The connector cell of claim 14, wherein the plurality of stacked fingers includes a third finger having a first end coupled to the body and a second end coupled to the second finger to provide support to the second finger.

19. The connector cell of claim 14, further comprising:

a first opening for the first finger to provide a first electrical interface for the connector cell;

another conductive extension coupled to the body; and a second opening for the another conductive extension to provide a second electrical interface for the connector cell.

20. The connector cell of claim 19, wherein the first and second openings are distally located relative to one another.

* * * * *